US006760050B1

(12) United States Patent
Nakagawa

(10) Patent No.: US 6,760,050 B1
(45) Date of Patent: Jul. 6, 2004

(54) VIRTUAL THREE-DIMENSIONAL SOUND PATTERN GENERATOR AND METHOD AND MEDIUM THEREOF

(75) Inventor: Teruhiko Nakagawa, Tokyo (JP)

(73) Assignee: Kabushiki Kaisha Sega Enterprises, Tokyo (JP)

( * ) Notice: Subject to any disclaimer, the term of this patent is extended or adjusted under 35 U.S.C. 154(b) by 0 days.

(21) Appl. No.: 09/275,396

(22) Filed: Mar. 24, 1999

(30) Foreign Application Priority Data

Mar. 25, 1998 (JP) ..... 10-077769

(51) Int. Cl.[7] ..... H04R 5/00

(52) U.S. Cl. ..... 345/848; 463/33; 463/35; 345/727

(58) Field of Search ..... 345/357, 145, 345/146, 339, 352–354, 473, 355, 425, 419, 848, 727; 381/17, 18, 104; 707/10; 463/32, 33, 34, 30, 31, 35; 340/384.7; 273/454, 460, 461

(56) References Cited

U.S. PATENT DOCUMENTS 3,831,172 A * 8/1974 Olliges et al. ..... 273/454
5,382,026 A * 1/1995 Harvard et al. ..... 463/30
5,487,113 A * 1/1996 Mark et al. ..... 381/17
5,633,993 A * 5/1997 Redmann et al. ..... 395/119
5,754,660 A * 5/1998 Shimizu ..... 381/17
5,784,467 A * 7/1998 Asayama ..... 381/17
5,862,229 A * 1/1999 Shimizu ..... 381/17
5,943,427 A * 8/1999 Massie et al. ..... 381/17
5,950,202 A * 9/1999 Durward et al. ..... 707/10
6,078,669 A * 6/2000 Maher ..... 381/17
6,091,421 A * 7/2000 Terrasson ..... 345/419
6,149,435 A * 11/2000 Park et al. ..... 434/30
6,154,549 A * 11/2000 Arnold et al. ..... 381/104
6,172,641 B1 * 1/2001 Millington ..... 342/357.13

FOREIGN PATENT DOCUMENTS

JP 4-316168 11/1992 ..... G06F/15/62

OTHER PUBLICATIONS www.sol.no/games/psgamer/rev_mp/pointb.htm; Point Blank review Feb. 18, 1998.*
www.consoledomain.com; Point Blank review Apr. 1, 1998.*
Final Doom software game and help text; Id Software, Inc, Copyright 1996.*
www.vgzone.com/reviews/psx/finaldoom.htm; Final Doom review release date Jun. 1996; printed Aug. 13, 2001.*
www.absolute–playstation.com/api_review/rfdoom.htm; Final Doom review, Oct. 1996.*
www.computerhope.com/doomx/htm; Final Doom; release date Jun. 1996.*
www.game–revolution.com/games/sony/fdoom; review of FinalDoom; Oct. 1996.*

* cited by examiner

*Primary Examiner*—John Cabeca
(74) *Attorney, Agent, or Firm*—Finnegan, Henderson, Farabow, Garrett & Dunner, L.L.P.

(57) ABSTRACT

A virtual three-dimensional sound pattern generator is provided. A player character may move within a virtual three-dimensional space using a sound source object and a sound marker. The player character may use the sound source object to shoot sound signals at the sound marker. The sound marker may then provide sound information based on the relative position of the sound source object for the player character, and based on materials of virtual objects. Audible sounds at prescribed positions and in prescribed directions within the virtual three-dimensional space are then provided.

8 Claims, 7 Drawing Sheets

VIRTUAL THREE-DIMENSIONAL SOUND PATTERN GENERATOR AND METHOD AND MEDIUM THEREOF

BACKGROUND OF THE INVENTION

1. Field of the Invention

The present invention relates to a three-dimensional sound pattern generator and a method and a medium thereof, and more particularly, to a virtual three-dimensional sound pattern generator for progressing a game which mainly depends on the player's auditory sense.

2. Related Art

As a virtual three-dimensional sound pattern generator of this kind, there is known a device comprising: an object storing portion for storing three-dimensional object information; a sound source storing portion for storing sound source information; a central processing portion for forming sound signals for generating sound reaching the position of a player character in conformity with the information concerning walls and other objects stored in the storing portions, information on the sound source, and the progress of the game; a speaker for converting the sound signals formed at the central processing portion into audible sounds; display means for displaying a picture of the game; and an operation panel for moving a character displayed on the display means. (For example, Patent Laid-Open Publication for Patent Application No. HEI 4-316168)

According to such virtual three-dimensional sound pattern generator, the player hears different sound effects, feeling as if he/she is standing at the same position and facing the same direction as the character which is moved on the display means with an operation panel. Thus, a sense of high virtual reality is provided to the player.

However, in certain conventional virtual three-dimensional sound pattern generators, sounds are reproduced only at the position and in the direction where such sounds are presumed to be heard assuming from the relative location of the character and other objects. Although higher virtual reality is obtained in these devices than in conventional devices, sounds are used only as means for effectively promoting the game as in other conventional devices, and active use of the sounds in the course of the game was not considered.

In view of the limitations encountered in the aforementioned prior art, an object of the present invention is to provide a virtual three-dimensional sound pattern generator and a method and a medium thereof based on a new idea of making an active use of sounds in the course of a game.

Another object of the present invention is to provide a virtual three-dimensional sound pattern generator and a method and medium thereof for progressing the game pursuant to the sound information that is changed by the player, for example, moving the sound source at his/her discretion.

SUMMARY OF THE INVENTION

In order to achieve the aforementioned objects, a virtual three-dimensional sound pattern generator of the present invention for forming sound patterns within a virtual space comprises: object information storing means for storing physical information on virtual objects arranged in the virtual three-dimensional space and information on materials of the virtual objects; operation means for controlling movement of a player character within the space structured by the virtual objects arranged in the virtual space and controlling shooting directions and sound generation of a sound source object; sound source storing means for storing sound source information of the sound source object; a plurality of sound conversion means for converting sound signals into audible sounds; and sound pattern processing means for variably controlling sound information on the sound source object of the player character in accordance with the position of the sound source object of the player character in the space structured by the virtual objects, information on the virtual objects arranged within the virtual three-dimensional space and information on the materials of the virtual objects, and for forming this sound information into sound signals audible at prescribed positions and in prescribed directions within the three-dimensional space, and providing the sound signals to the sound conversion means.

In order to achieve the aforementioned objects, a virtual three-dimensional sound pattern generator of the present invention for forming sound patterns within a virtual space comprises: object information storing means for storing physical information on virtual objects arranged in the virtual three-dimensional space and information on materials of the virtual objects; operation means for controlling movement of a sound marker within the space structured by the virtual objects arranged in the virtual space and controlling sound generation; sound source storing means for storing sound source information of the soundmarker; a plurality of sound conversion means for converting sound signals into audible sounds; and sound pattern processing means for variably controlling sound information on the sound marker in accordance with the position of the sound marker in the space structured by the virtual objects, information on the virtual objects arranged within the virtual three-dimensional space and information on materials of the virtual objects constituting structures in the virtual three-dimensional space, and for forming the sound information into sound signals audible at prescribed positions and in prescribed directions within the three-dimensional space, and providing the sound signals to the sound conversion means.

In order to achieve the aforementioned objects, a virtual three-dimensional sound pattern generator of the present invention for forming sound patterns within a virtual space comprises: object information storing means for storing physical information on virtual objects arranged in the virtual three-dimensional space and information on materials of the virtual objects; operation means for controlling movement of a player character and a sound marker within the space structured by the virtual objects arranged in the virtual space and controlling shooting directions of a sound source object or sound generation of the sound source object and the sound marker; sound source storing means for storing sound source information of the sound source object of the character and the sound marker; a plurality of sound conversion means for converting the sound signals into audible sounds; and sound pattern processing means for variably controlling sound information on the sound source object of the character and/or sound marker in accordance with the relative position of the sound source object of the character and the sound marker in the space structured by the virtual objects, information on the virtual objects arranged within the virtual three-dimensional space and information on materials of the virtual objects constituting structures in the virtual three-dimensional space, and for forming the sound information into sound signals audible at prescribed positions and in prescribed directions within the three-dimensional space, and providing the sound signals to the sound conversion means.

The sound pattern processing means of the present invention comprises means of the present invention comprises means for changing the sound information on the sound marker in accordance with the information on materials of the virtual objects upon identification of collision of the marker with the virtual objects during its movement through the space structured by the virtual objects in conformity with the operational command from the operation means.

The sound pattern processing means of the present invention comprises means for forming sound information of the moved sound on the basis of movement of the character within the space structured by the virtual objects.

The sound conversion means of the present invention is capable of reproducing three-dimensional sounds.

In order to achieve the aforementioned objects, a method of the present invention for generating virtual three-dimensional sound patterns whereby sound patterns are formed within a virtual space, comprises the steps of: controlling movement of a player character within a space structured by virtual objects arranged in the virtual space on the basis of operational commands from the operation means and controlling shooting directions and sound generation of a sound source object within the space; variably controlling sound information on the character in accordance with a position of the sound source object of the player character within the space structured by the virtual objects, information on the virtual objects arranged within the virtual three-dimensional space and information on materials of the virtual objects; and allowing sounds to be heard at prescribed positions and in prescribed directions within the three-dimensional space.

In order to achieve the aforementioned objects, a method of the present invention for generating virtual three-dimensional sound patterns whereby sound patterns are formed within a virtual space, comprises the steps of: controlling movement of a player character and a sound marker in a space structured by virtual objects arranged in the virtual space on the basis of operational commands from the operation means and controlling sound generation of the sound marker; variably controlling sound information on the sound marker in accordance with a position of the sound marker within the space structured by the virtual objects, information on the virtual objects arranged within the virtual three-dimensional space and information on materials of the virtual objects; and allowing sounds to be heard at prescribed positions and in prescribed directions within the three-dimensional space.

In order to achieve the aforementioned objects, a method of the present invention for generating three-dimensional virtual sound patterns whereby sound patterns are formed within a virtual space, comprises the steps of: controlling movement of a player character and a sound marker in a space structured by virtual objects arranged in the virtual space on the basis of operational commands from the operation means, as well as controlling shooting directions of the sound source object and the sound marker; variably controlling sound information on the source object of the character and/or sound marker in accordance with the relative position of the sound source object of the player character and the sound marker within the space structured by virtual objects; and allowing sounds to be heard at prescribed positions and in prescribed directions within the three-dimensional space.

In order to achieve the aforementioned objects, a medium of the present invention has recorded therein, a program causing a computer to function as the aforementioned processing portion or a data device.

The medium above stores information (for example, a game program) by certain physical means, and is capable of causing game devices and other information processing devices to execute predetermined functions, for example, execution of a game program.

The aforementioned medium includes, for example, a CD-R, a game cartridge, a floppy disc, a magnetic tape, an optical magnetic disc, a CD-ROM, a DVD-ROM, a DVD-RAM, a ROM cartridge, a battery backup RAM, a flash memory, a non-volatile cartridge, and the like.

Furthermore, the medium above further includes a communication medium such as a telephone circuit, an optical cable, or other wire communication media, or radio communication media, etc. Internet is also included in such communication media.

DESCRIPTION OF THE DRAWINGS

BRIEF DESCRIPTION OF THE DRAWINGS

Figure 1:
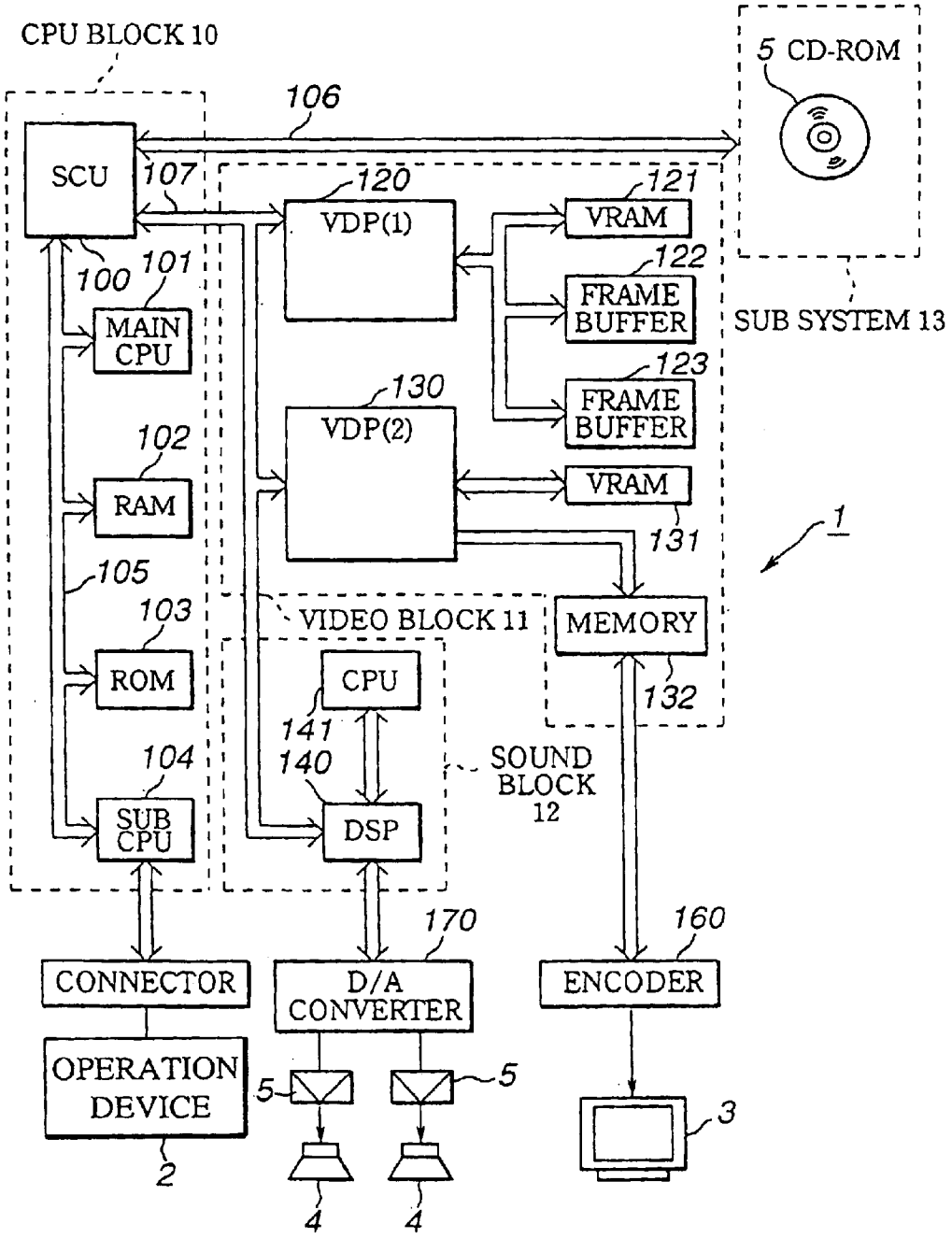

FIG. 1 is a block diagram showing the outline of the game device employing the virtual three-dimensional sound pattern generator according to an embodiment of the present invention.

Figure 2:
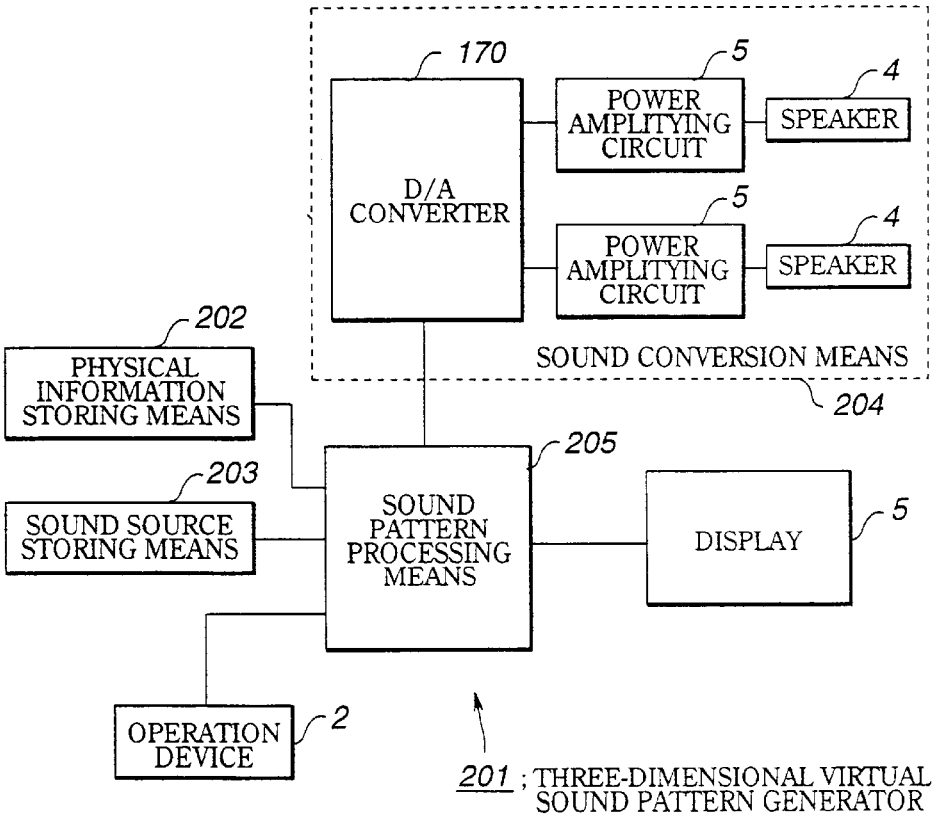

FIG. 2 is a block diagram showing the virtual three-dimensional sound pattern generator of the same embodiment.

Figure 3:
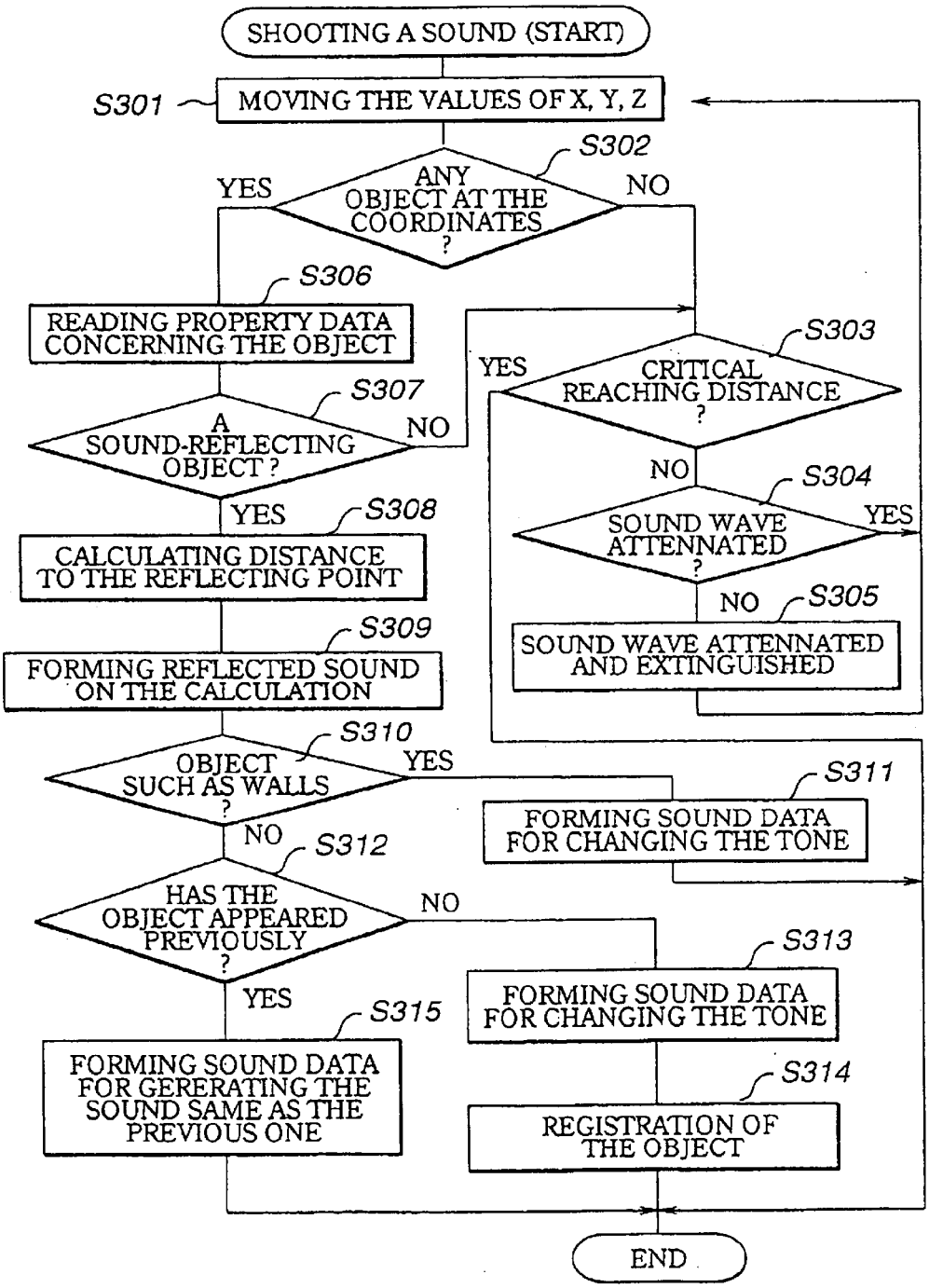

FIG. 3 is a flowchart illustrating the sound pattern processing of the sound source object held by the player character of the same embodiment.

Figure 4:
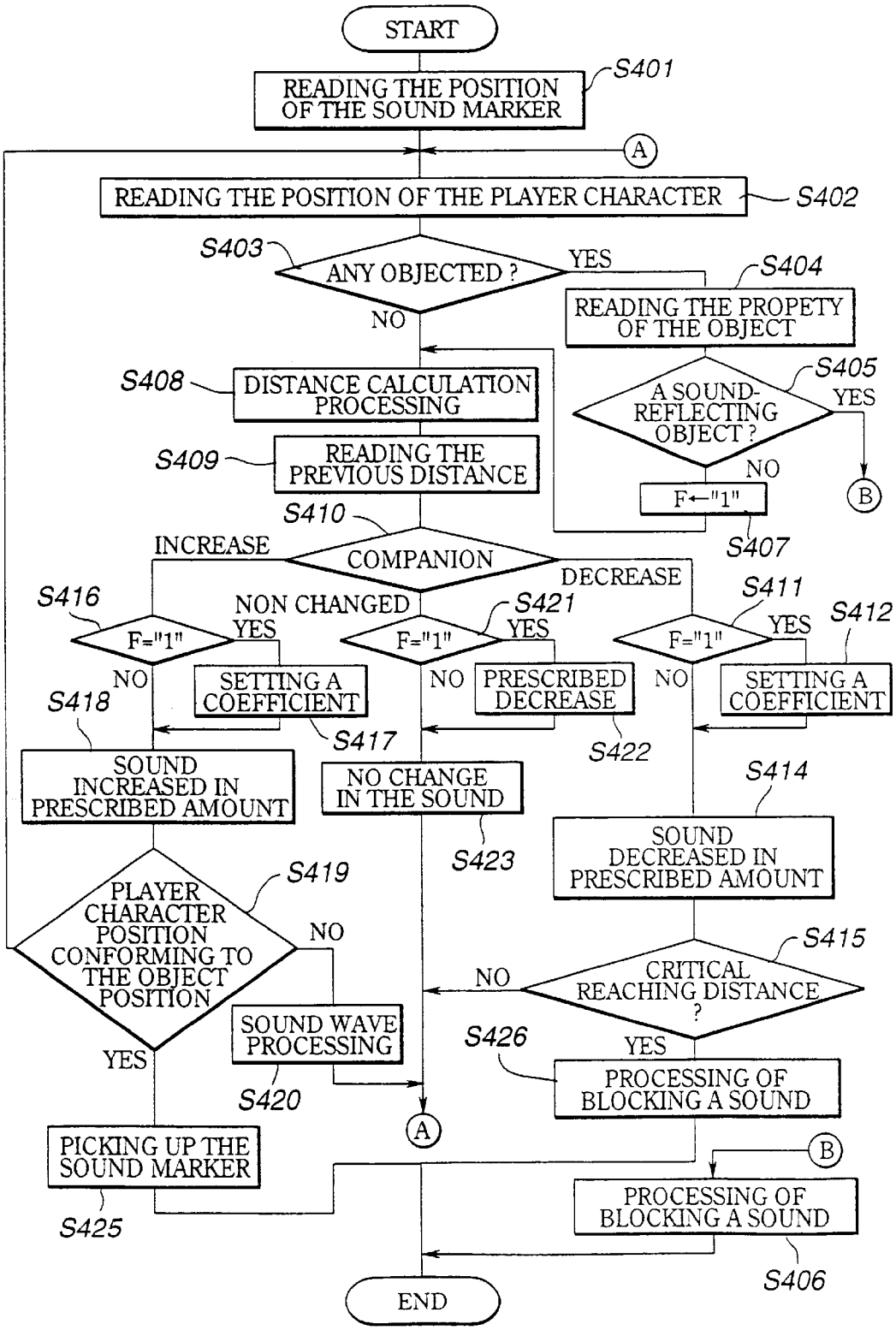

FIG. 4 is a flowchart illustrating the first sound pattern processing of the sound marker of the same embodiment.

Figure 5:
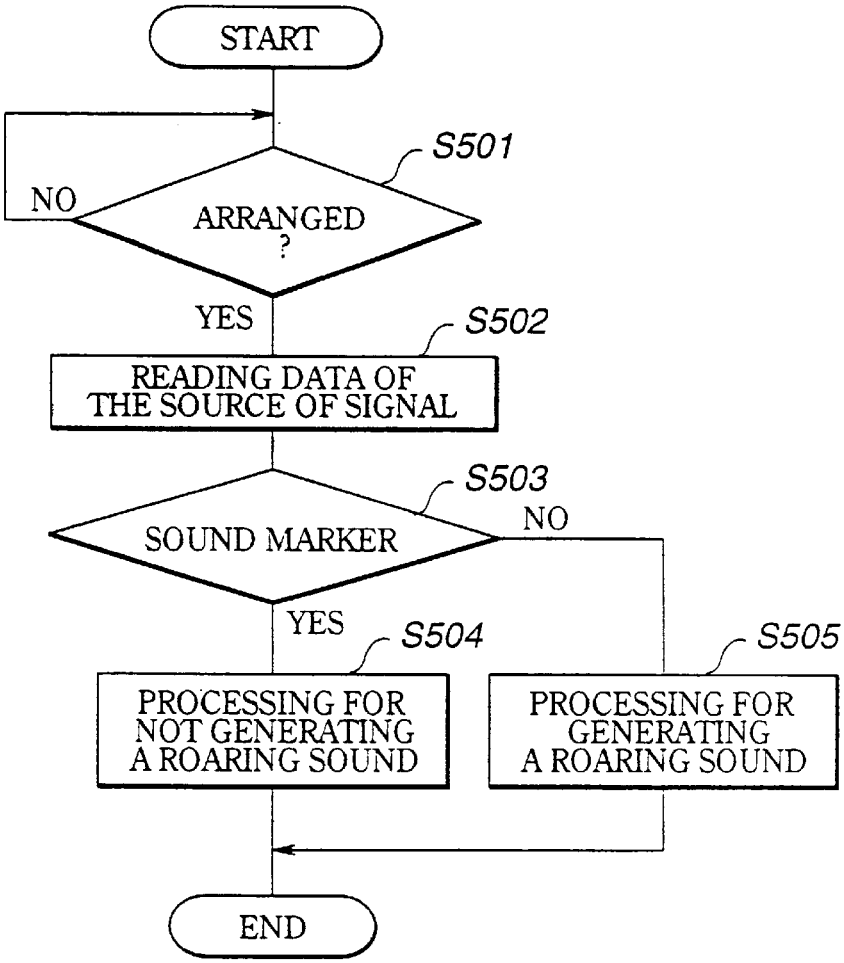

FIG. 5 is a flowchart illustrating the first sound pattern processing of the sound marker of the same embodiment.

Figure 6:
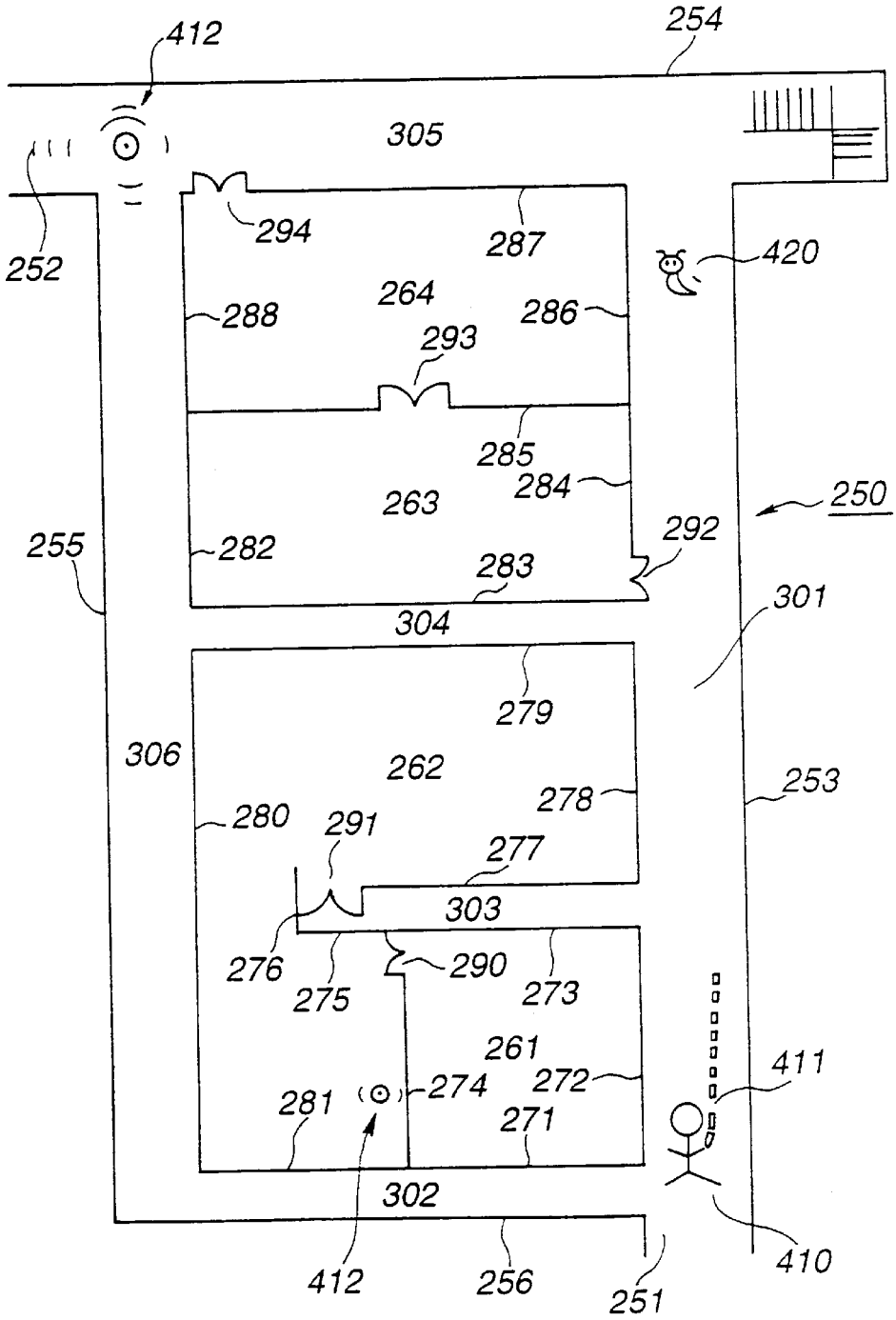

FIG. 6 is a block diagram showing an example of space structured by objects arranged in the virtual space which is to be used in the game of the same embodiment.

Figure 7:
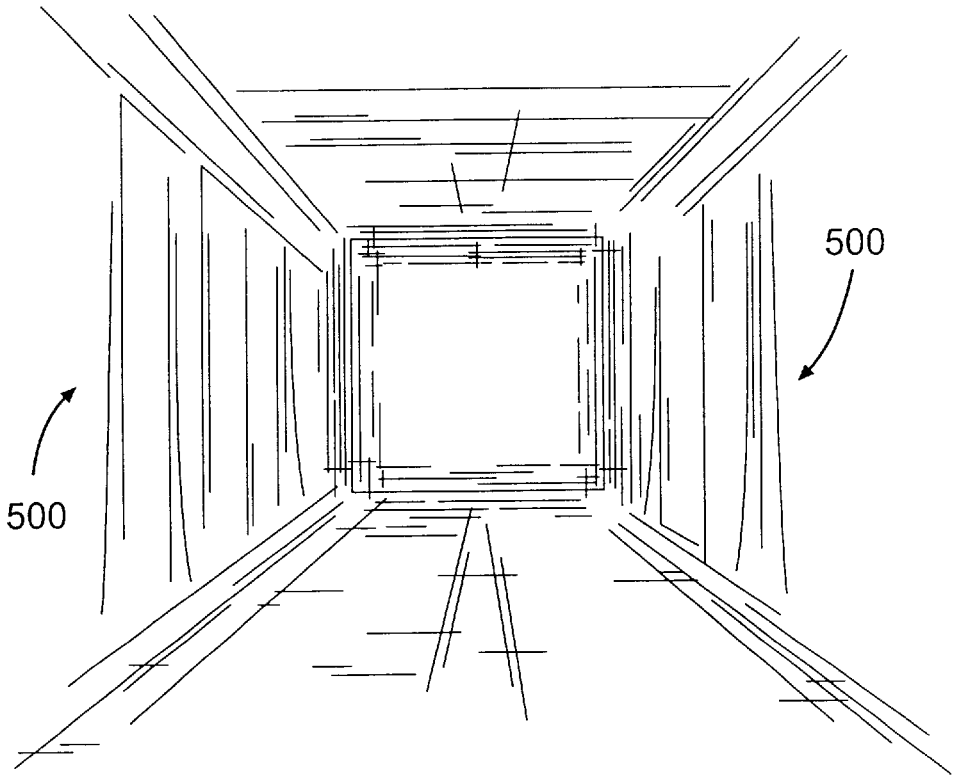

FIG. 7 is an explanatory diagram showing an example of a construction structured by objects arranged in the virtual space, used in the same embodiment.

DESCRIPTION OF A PREFERRED EMBODIMENT

A preferred embodiment of the present invention will be explained below with reference to the drawings.

"Structure"

FIG. 1 is a block diagram showing an outline of the game device which employs a virtual three-dimensional sound pattern generator according to an embodiment of the present invention. In FIG. 1, a game device comprises a body 1 of a processing device, an operation device 2, a display 3, and a plurality of speakers 4, 4.

The body 1 of the processing device comprises a CPU block 10 for controlling the overall device, a video block 11 for controlling display of the game screen, a sound block 12 for generating sound effects etc., and a subsystem 13 for reading out a CD-ROM 5.

The CPU block 10 comprises an SCU (System Control Unit) 100, a main CPU 101, a RAM 102, a ROM 103, a sub CPU 104, a CPU bus 105, etc.

The main CPU 101 controls the overall device. A computing function similar to a DSP (Digital Signal Processor) is included inside the main CPU 101, allowing execution of application software at a high speed. The RAM 102 is used as a work area of the main CPU 101. In the ROM 103, an initial program for an initialization processing, etc. are written. The SCU 100 controls buses 105, 106 and 107, and thereby allows smooth input and output of data among the main CPU 101, VDPs 120 and 130, DSP 140, CPU 141, etc. Moreover, the SCU 100 includes a DMA controller inside, allowing transfer of spright data in the game to VRAMs in the video block 11. The above-described construction enables execution of games and other application software at a high speed.

The sub CPU 104 is called the SMPC (System Manager & Peripheral Control), comprising functions such as collecting data via the operation device (peripheral) 2 upon the request of the main CPU 101. The main CPU 101 implements processing such as moving the character in the game screen in conformity with the operation (peripheral) data received from the sub CPU 104. The sub CPU 104 comprises functions such as automatically recognizing the types of peripherals connected to a connector 6 and collecting peripheral data etc. in accordance with the communication method used for the respective types of peripherals.

The video block 11 comprises a VDP (Video Display Processor) 120 for drawing video game characters etc. made of polygon data, and a VDP 130 for drawing background images, synthesizing polygon image data and background images and implementing a clipping processing thereof. The VDP 120 is connected to a VRAM 121 and frame buffers 122 and 123. The drawing data with polygons representing video game characters are sent to the VDP 120 from the main CPU 101 via the SCU 100 so that they are written in the VRAM 121. The drawing data written in the VRAM 121 are drawn to the frame buffer 122 or 123 in the form of, for example, 16 or 8 bit/pixel. Data drawn to the frame buffer 122 or 123 are sent to the VDP 130. Information for controlling the drawing is provided to the VDP 120 from the main CPU 101 via the SCU 100. The VDP 120 executes a drawing processing according to such instructions.

The VDP 130 is connected to a VRAM 131 and is structured so that image data output from the VDP 130 are output to an encoder 160 via a memory 132. By adding synchronous signals etc. to these image data, the encoder 160 generates video signals and displays such signals on the display 3. A game screen is thus displayed on the display 3.

The sound block 12 comprises a DSP 140 which conducts voice synthesis under a PCM or an FM method and a CPU 141 which conducts control etc. of the DSP 140. Voice data produced by the DSP 140 are converted into multi-channel analog sound signals by a D/A converter 170, and the electric power of the voice data is amplified at the power amplifying circuits 6, 6 and thereafter respectively output to a plurality of speakers 4, 4.

The subsystem 13 comprises functions such as reading application software provided in the form of the CD-ROM 5 and reproducing animation data and voice data.

"Functional block"

FIG. 2 is a block diagram showing the virtual three-dimensional sound pattern generator described above. In FIG. 2, the virtual three-dimensional sound pattern generator 201 comprises: object information storing means 202 for storing physical information on virtual objects arranged in a virtual three-dimensional space and information on materials of such virtual objects; an operation device 2 for controlling the movement of a character and/or a sound marker within a space structured by virtual objects arranged in the virtual space and for controlling shooting directions from a sound source object of the player character and generation of sounds for the sound source object and the sound marker; sound source storing means 203 for storing information concerning the character and the sound source object; a plurality of sound conversion means 204 for converting the aforementioned sound signals into audible sounds; and sound pattern processing means 205 for variably controlling sound information on the sound source object of the player character or the sound marker in accordance with the position of the sound source object of the player character and/or the sound marker within the space structured by virtual objects arranged in the virtual space and information on materials of the virtual objects, and for forming sound signals audible at the predetermined position and direction in the virtual three-dimensional space and thereafter providing such sound signals to the sound conversion means 204.

The sound conversion means 204 comprises: a plurality of speakers 4, 4; power amplifying circuits 6, 6 for amplifying the power of signals output from the D/A converter 170 and driving the plurality of speakers 4, 4; and a D/A converter 170 providing sound signals to each of the power amplifying circuits 6, 6.

The sound pattern processing means 205 is realized in the following manner. First of all, a program stored in the CD-ROM 5 is developed in the RAM 102 by the main CPU 101. The main CPU 101 executes a program developed in the RAM 102 and reads and processes operation data received from the operation device 2, and also controls operation of a video block 11 and a sound block 12, thereby realizing the sound pattern processing means 205. Physical information on the virtual objects arranged in the virtual three-dimensional space and information on materials of the virtual objects are stored in the object information storing area in the RAM 102. Furthermore, information concerning the character and the sound source object is also stored in the object information storing area in the RAM 102. If all of the information may not be stored in the RAM 102, data up to the end of a prescribed scene in the course of the game can be fetched from the CD-ROM 5 on each occasion so that such data are developed at the desired area in the RAM 102.

FIG. 6 is a diagram showing an example of a space structured by objects arranged in the virtual space, which may be used in the game. A plan view of a building 250 is shown in FIG. 6. The purpose of the game is to bring the player character from the starting point 251 at the building 250 to the goal 252.

The building 250 has the following construction: The building 250 is surrounded by exterior walls 253, 254, 255 and 256. Inside the building 250, there are rooms 261, 262, 263, and 264. Room 261 is structured by walls 271, 272, 273, 274 which surround a predetermined area. Room 262 is structured by walls 274, 275 . . . , 281 which surround a predetermined area. Room 263 is structured by walls 282, 283, 284, 285 which surround a predetermined area. Room 264 is structured by walls 285, 286, 287, 288 which surround a predetermined area.

On wall 274 of room 261, door 290 is furnished, providing a passage only to room 262. On wall 277 of room 262, door 291 is furnished, thereby providing a passage between room 262 and hallway 303. On the respective walls 284 and 285 of room 263, doors 292 and 293 are furnished. Door 292 provides a passage between hallway 301 and room 263, while door 293 provides a passage between room 263 and room 264. On wall 287 of room 264, door 294 is furnished, providing a passage between hallway 305 and room 264.

Hallway 301 is connected with hallways 302, 303, 304 and 305. Hallway 306 is connected with hallways 302, 304 and 305.

An enemy character 420 may be arranged, for example, near the intersection of hallway 301 and hallway 305.

Let it be presumed that the above-described space structured by doors and other virtual objects arranged in the virtual space presents a dark environment with limited visibility as being under turbid water. Therefore, almost nothing is displayed in the game picture shown on the display 5.

On the other hand, the medium filled in the aforementioned space structured by the virtual objects is conditioned to have an incredible sound transferring ability but an extremely low sound transferring speed. In this space, the player character 410 holds a sound source object 411 capable of shooting sound waves in various directions, namely, forward, backward, rightward, leftward, upward and downward. Furthermore, the player character 410 carries different types of sound markers 412, 412, . . . , which can be thrown or arranged within the aforementioned space. The shooting sounds from the sound source object 411 and the sound marker 412 can be modulated according to the features of the respective objects.

By operating the operation device 2, the player moves the character through the space, aiming to bring the character from the start 251 to the goal 252. On the way to the goal, an enemy character 420 may appear. Since there may be fellow comrades within the space, attack is made only after confirming them with the sound wave.

If the player hears a reflected sound after shooting a sound wave with the shooting means, it is obvious that some object exists in the direction of the reflected sound; if the player hears no reflected sound, it means that no object exists in that direction. Moreover, by the volume of the reflected sound, the player can assume the distance between the player character 410 and the object. For example, upon shooting in the upward direction in FIG. 6 from hallway 301, no reflected sound will be heard, meaning that no object exists in that direction. Whereas, upon shooting at wall 272, an immediate reflected sound will be heard, and such sound being loud, the player can assume that there is an object nearby.

The sound marker 412 is made so that various types of sounds, for example, continuous sounds or pulse sounds can be shot. Moreover, the sound marker 412 may generate a special sound. The sound marker 412 may be operated by the character 410. Furthermore, the sound of the sound marker 412 can also be controlled by the player character 410. In reality, the player can give commands by operating the operation device 2. Furthermore, sound markers can be dropped at different points so as to avoid taking the same route many times or coming to a dead end.

When the player character 410 stands at the start 251, the display 5 displays an image picture 500 of the hallway as shown in FIG. 7, urging the player character 410 to pass through the dark hallway. As the player character enters the hallway, almost nothing is displayed in the game picture shown on the display 5. The player checks the state of the sounds and moves the player character ahead towards the goal 252.

Data stored in the object information storing means 202 include: data (three-dimensional) concerning the arrangement of the exterior walls 253 through 256, walls 271 through 282, doors 290 through 294, etc.; data (three-dimensional) concerning the arrangement of floors and ceilings, etc. Which are not illustrated herein; data concerning the materials of these components 253 through 256, 271 through 282, 290 through 294, the floors and the ceilings; data concerning hallways 301 through 306; and data (three-dimensional) concerning the arrangement of the enemy character 420. Furthermore, the sound source means 203 stores data concerning the player character 410 and data on the sound of the sound source object.

"Sound Pattern Processing by the Sound Source Object of the Player Character".

The sound pattern processing operation of the sound source object carried by the player character in the embodiment above will be explained below with reference to FIGS. 1 through 3, and FIGS. 6 and 7. FIG. 3 is a flowchart illustrating the sound pattern processing implemented by the sound source object of the player character.

This sound pattern processing is implemented under a presumption that the player character 410 is standing in the three-dimensional space represented by a rectangular coordinate system of (X, Y, Z). The point where the player character 410 is standing shall be the central point or the origin, represented as X0, Y0, Z0.

When the player wishes to check if any object exists in a certain direction from the point where the player character is standing, the player shoots a sound wave in that direction with the sound source object 411 held by the player character 410.

Given such a command, the main CPU implements processing shown in the flowchart of FIG. 3. Suppose a sound wave is shot, for example, in the direction of the x-axis. In order to reduce the burden caused to the main CPU 101, the progress of the sound wave is processed on the presumption that a prescribed area D proceeds along the x-axis in conformity with the travelling speed of the sound wave. The area D will be represented as $\{Y^2+Z^2=K^2\}$ and processed as if a circular plate having a radius K moves through the space at the speed of the sound wave.

In order to make the area D move in conformity with the travelling speed of the sound wave, the value of the x-axis of the area D is changed at the main CPU 101 in conformity with the travelling speed of the sound wave (S301). As already mentioned, the medium filled in the virtual space above is conditioned as having an incredible sound transferring ability but an -extremely low sound transferring speed. However, increase and decrease in the amplitude shall be proportionate to the distance.

By changing the value of the x-axis subject to the aforementioned condition and arranging the area D at coordinates where the sound wave is to reach after a prescribed period of time, the area D is moved in equal amount by the main CPU 101 in accordance with the travelling speed of the-sound wave. Furthermore, based on such coordinates of the area D, the main CPU 101 browses the object information storing means 202 to determine whether or not there is any object at the coordinates above (S302). When the main CPU 101 identifies no object at the coordinates of the area D (S302; NO), the main CPU 101 further determines whether or not the sound wave has reached the "critical reaching distance". Here, the "critical reaching distance" means a distance that the sound wave may no longer reach the point of the player character 410 even when reflected, due to the gradual attenuation of the sound wave amplitude during movement through the medium.

When the main CPU 101 determines that the area D has not yet reached the critical reaching distance (S303; NO), the main CPU 101 determines whether or not the attenuation processing has been implemented (S304). When the main CPU 101 determines that the attenuation processing has not been implemented (S304; NO), the main CPU 101 orders the sound block 12 to attenuate and finally extinguish the soundwave (S305). Given such order, the speakers 4, 4 reproduce a sound pattern of a sound wave being shot from the sound source object 411 held in the hands of the player character 410, for example, a sound pattern of a shooting sound extinguishing immediately after being heard. Then, the processing of the main CPU 101 returns to step S301 again.

In conformity with the travelling speed of the sound wave, the main CPU 101 changes the x-axis value of the area D so that it becomes equal to the distance which the sound wave has moved along the x-axis after a certain period of time (S301). As a result, the area D proceeds along the x-axis from its previous position. On the basis of the coordinates of the area D, the main CPU 101 browses the object information storing means 202 at the RAM 102 and determines whether or not any object exists at the coordinates above (S302). When no object is identified at the coordinates of the area D (S302; NO), the main CPU 101 determines again whether or not the area D has reached the critical reaching distance. When it is determined that the area D has not reached the critical reaching distance (S303; NO), the main CPU determines whether or not the attenuation processing has been implemented (S304). Since the execution of such processing is identified by the main CPU 101 (S304; YES), the processing returns to step S301 again.

The aforementioned processing S301 through S304 is repeated by the main CPU 101.

The main CPU 101 repeats step S S301 through S304 and quits the processing upon determining that the area D (sound wave) has reached the critical reaching distance (S303; YES). Since the attenuation property of the sound wave amplitude is at first unknown to the player, in order to inform the player that the sound wave has reached the critical reaching distance, a command for displaying flickering signals on the sound source object 411 may be given to the video block 11, or a command for generating a special sound may be given to the sound block 12. By doing so, the player will sense the critical reaching distance and make use of such sense in the next stage.

On the other hand, the main CPU 101 repeats step S S301 through S304, and, on the basis of the current position of the area D, browses the object information storing means 202. When an object is identified at the coordinates of the area D (S302; NO), the main CPU 101 fetches data regarding such object from the object information storing means 202 at the RAM 102 (S306). Then, the main CPU 101 determines whether or not the object has a sound reflecting property, and if the object is found to be anon-sound-reflecting object (S307; NO), the processing shifts to determination of the critical reaching distance. This is because, if an object does not reflect any sound wave, the sound wave either penetrates through the object or is reduced and extinguished inside the object, and therefore, the object may be thoroughly neglected as if not existing at all.

Furthermore, if, on the basis of the data stored in the object information storing means 202, the main CPU 101 determines that the object in question is a sound-reflecting object (S307; YES), the distance between the sound source object 411 and the object will be calculated (S308). According to this calculation, the main CPU 101 forms a command for outputting a reflected sound from the object with an attenuated sound wave amplitude depending on the distance to and back from the object (S309).

If the main CPU 101 determines that the object is a wall or other structures pursuant to the property data thereof (S310; YES), the aforementioned command from step S309 and a command for outputting a sound in the same tone as the shooting sound from the sound source object 411 are provided to the sound block 12 (S313). As a result, some time after shooting of the sound wave, a reflected sound having exactly the same tone as the shooting sound will be heard from the direction where the sound wave has been shot using the sound source object 411. Moreover, the player will perceive a sound pattern with attenuated sound wave amplitude depending on the distance to the object. Consequently, the player will understand that there is a wall in the direction to which the sound source object 411 of the player character 410 is pointed, and that the wall is at a distance equal to half the time before the reflected sound is heard after the shooting of the sound wave from the sound source object 411.

On the other hand, if the main CPU 101 determines on the basis of the object property data above that the object is not a wall or other structures (S310; NO), the main CPU 101 checks the registration area where objects previously appearing in the game are registered and compares the property data of the object with data stored in the registration area. When it is determined that the property data do not conform with any of the previous data (S312; NO), the main CPU 101 forms a command for changing the tone from any previous tones and gives such command to the sound block 12 together with the command from step S309 above (S313). As a result, some time after the shooting of a sound wave, a reflected sound is heard from the direction where the sound wave has been shot using the sound source object 411, but in a tone unfamiliar to the player. The sound pattern provided to the player will have an attenuated sound wave amplitude depending on the distance to the object. Consequently, the player will know from the tone that this object has never been identified. After registering the property of the object at the registration area (S314), the main CPU 101 quits this processing. The purpose of step S314 is to allow formation of the same reflected sound in the subsequent processing when an object having the same property appears.

Furthermore, if the main CPU 101 determines on the basis of the object property data above that the object is not a wall or other structures (S310; YES), the main CPU 101 checks the registration area where the objects previously appearing in the game are registered, and compares the property data of the object with the data stored in the registration area. When the main CPU 101 determines that the property data of the object conforms with previous data (S312; YES), a command for generating sound in the same tone as the sound previously output is given to the sound block 12 together with the command from the aforementioned step S309 (S315). As a result, some time after the shooting of the sound wave, a reflected sound in a familiar tone will be heard from the direction to which the sound wave has been shot using the sound source object 411, thereby providing the player with a sound pattern of attenuated sound wave amplitude depending on the distance to such object.

The explanation above gives an example of the area D moving along the x-axis, it is needless to mention that the area D may also be considered as moving among coordinates in the (X, Y, Z) rectangular coordinate system.

As already explained, by shooting a sound wave from the sound source object held by the player character 410, the player checks the inner condition of the building 250 on the basis of the reflected sound, namely, by whether or not any reflected sound is heard, and thereby moves the player character ahead through the building 250 from the start 251 to the goal 252.

[First Sound Pattern Processing Operation of the Sound Marker]

Next, the sound pattern processing operation according to the same embodiment will be explained referring to FIGS. 1, 2, 4, 6 and 7. FIG. 4 is a flowchart explaining the first sound pattern processing operation of the sound marker.

In the first sound pattern processing operation of the sound marker, the sound marker 412 is placed at a prescribed position and the situation of the player character 410 is determined based on the changes in the positions of the sound marker 412 and the player character 410. More specifically, by this sound pattern processing, the player may determine the situation of the player character 410 upon respective sound patterns of "an attenuated sound", "an amplified sound", "change in the character position and no change in the sound volume" or "a sudden difficulty in hearing any sound."

More specifically, if a sound pattern of "an attenuated sound" is formed by the main CPU 101 and commanded to the sound block 12 while the player operates the operation device 2 to move the player character 410, a sound pattern of an attenuated sound will be provided. Accordingly, the player will know from such sound pattern that the player character 410 is moving away from the sound marker 412.

Furthermore, if a sound pattern of "amplified sound" is formed by the main CPU 101 and commanded to the sound block 12 while the player character 410 is being moved, there will be a sound pattern of an amplified sound. As a result, the player will know from this sound pattern that the player character 410 is approaching the sound marker 412.

Furthermore, if a sound pattern of "change in the character position and no change in the sound volume" is formed by the main CPU 101 and commanded to the sound block 12 while the player character 410 is moved, there will be provided a sound pattern with the character position being changed and the sound volume remaining unchanged. As a result, the player will know from this sound pattern that the player character 410 is moving in parallel with the sound marker 412.

Furthermore, if a sound pattern of "a sudden difficulty in hearing any sound" is formed by the main CPU 101 and commanded to the sound block 12 while the player character 410 is being moved, there will be a sound pattern of any sound suddenly becoming difficult to be heard. Accordingly, the player will know from such sound pattern that there is an obstacle between the player character 410 and the sound marker 412.

Operations for forming these sound patterns will be explained referring to the flowchart of FIG. 4. A precondition for these operations is that the sound marker 412 is arranged at a prescribed position. The operation device 2 is operated and the player character 410 is moved. First of all, the main CPU 101 reads the position of the sound marker 412 (S401). Subsequently, the main CPU 101 reads the position of the player character 410 (S402). On the basis of the position data of the character 410 and the sound marker 412, the main CPU 101 browses the object information storing means 202 at the RAM 102 to determine whether or not there is any obstacle between the character 410 and the sound marker 412 (S403). If the main CPU 101 determines that there is an obstacle between the character 410 and the sound marker 412 (S403; YES), the main CPU 101 reads the property data of the obstacle from the object information storing means 202 (S404). Subsequently, the main CPU 101 determines whether or not such object reflects any sound wave (S405). If the main CPU 101 determines that the object reflects a sound wave (S405; YES), the main CPU 101 implements a processing, making it difficult to hear any sound, and thereafter quits the processing (S406; YES). In other words, by step S S401 through 406, there is formed a sound pattern of "a sudden difficulty in hearing any sound."

Otherwise, if the main CPU 101 determines that the object in question does not reflect any sound wave (S405; NO), the main CPU 101 sets "1" to a flag F (S407) and calculates the distance between the player character 410 and the sound-marker 412 (S408). Subsequently, the main CPU 101 reads the distance of the player character 410 and the sound marker 412 which has been stored the previous time (S409). The main CPU 101 compares the current distance of the player character 410 and the sound marker 412 with the previous distance thereof (S410).

If the main CPU 101 determines that the distance between the player character 410 and the sound marker 412 has decreased (S410; decreased), the main CPU 101 identifies whether or not "1" is set to the flag F (S411). In this case, "1" is set to the flag F (S411; YES), and therefore, the main CPU sets an attenuation coefficient in accordance with the property of the object (S412), and the amplitude of the sound wave is decreased for the amount of the prescribed attenuation coefficient depending on the property of the object (S414). Subsequently, the main CPU 101 determines whether or not the player character 410 has reached the critical reaching distance (S415). If the player character 410 has not reached the critical reaching distance (S415; No), the main CPU 101 reads the position data of the player character 410 again (S402). As a result of step SS401 through S405, steps S407 through S415, and a command given to the sound block 12, the speakers 4, 4 reproduce an attenuated sound wave due to the sound passing through a sound-penetrating object. Accordingly, the player hears a sound pattern of a sound wave with a suddenly decreased volume.

On the other hand, if the main CPU 101 determines that the distance between the player character 410 and the sound marker 412 has increased (S410; increased), the main CPU 101 determines whether or not "1" is set to the flag F (S416). In this case, "1" is set to the flag F (S416; YES), and therefore, the main CPU sets an attenuation coefficient in accordance with the property of the object (S417), and the amplitude of the sound wave is increased in conformity with a prescribed attenuation coefficient depending on the property of the object (S418). Subsequently, the main CPU 101 determines whether or not the player character has reached the object (S419). If the position of the player character 410 conforms with the position of the object (S419, conforming to the position of the object), there is implemented a processing of discontinuing any further increase of the sound wave, and the processing returns to step S402.

Furthermore, if the main CPU 101 determines that the distance between the player character 410 and the sound marker 412 remains unchanged (S410; unchanged), the main CPU 101 determines whether or not "1" is set to the flag F (S421). Since "1" is set to the flag F in the present case (S421; YES), the sound will be attenuated in accordance with the attenuation coefficient depending on the property of the object (S422), and the main CPU further implements a processing of changing the position of the player character 410 without changing the level of the sound wave (S423). Consequently, the player character 410 is found moving, keeping a certain distance from the sound marker 412.

According to the operation above, in a case where an object exists between the player character 410 and the sound marker 412 and such object reflects a sound wave completely, a processing of considerably decreasing or blocking the sound wave is implemented; whereas, in a case where the aforementioned object allows complete penetration of the sound wave, there is provided a sound pattern with an increased sound wave amplitude pursuant to the prescribed attenuation rate when the player character 410 is approaching the sound marker 412, and a sound pattern is provided with a more decreased sound wave amplitude than regular amplitude attenuation when the player character 410 is moving away from the sound marker 412.

Furthermore, if the main CPU 101 determines that there is no obstacle between the player character 410 and the sound marker 412 (S403; NO), steps S408 and S409 are implemented so as to compare the distance between the player character 410 and the sound marker 412 with the previous distance thereof (S410).

Moreover, if the main CPU 101 determines that the distance between the player character 410 and the sound marker 412 has decreased (S410; decreased), the main CPU 101 determines whether or not "1" is set to the flag F (S411) In this case, "0" is set to the flag F because no object exists in between (S411; NO), and therefore, the amplitude of the sound wave is attenuated only for the amount of the attenuation coefficient of the space (S414). Subsequently, the main CPU 101 determines whether or not the player character 410 has reached the critical reaching distance (S415). If the player character 410 has not reached the critical reaching distance (S415; NO), the main CPU 101 reads data concerning the position of the player character 410 (S402). As a result of step S S401 through S403, steps S408 through S410, steps S412, S414 and S415, and a command given to the sound block 12, the speakers 4, 4 reproduce a sound which is decreased only for the amount of the attenuation coefficient of the virtual space. Consequently, a sound pattern with a decreased sound wave is provided to the player. Thus the player is provided with a sound pattern of the player character 410 gradually moving away from the sound marker 412.

On the other hand, if the main CPU 101 determines that the distance between the player character 410 and the sound marker 412 has increased (S410; increased), the main CPU 101 determines whether or not "1" is set to the flag F (S411). In this case, "0" is set to the flag F because there is no object in between (S416; NO), and therefore, the amplitude of the sound wave is increased in accordance with the attenuation coefficient of the virtual space (S418). Subsequently, the main CPU 101 determines whether or not the position of the player character 410 conforms to the position of the sound marker 412 (S419). If the position of the player character 410 does not conform to the position of the sound marker 412 (S419; NO), the main CPU 101 again returns to the processing of reading the position data of the player character 410 (S402). As a result of steps S401 through S403, steps S408 through S410, steps S416, S418 and S419, and a command given to the sound block 12, the speakers 4, 4 reproduce a sound gradually increasing in the space. Consequently, the player is provided with a sound pattern with a sound wave being decreased by a normal distance. As a result, a sound pattern of the player character 410 gradually approaching the sound marker 412 is provided.

Furthermore, if the main CPU 101 determines that the distance between the player character 410 and the sound marker 412 remains unchanged (S410; unchanged), the main CPU 101 determines whether or not "1" is set to the flag F (S421). In this case, since "0" is set to the flag F (S421; NO), there is implemented a processing of changing the position of the player character 410 without changing the level of the sound wave (S423). Consequently, the player character 410 is found moving, keeping a certain distance from the sound marker 412.

According to the operation above, in a case where there is no object between the player character 410 and the sound marker 412, a sound pattern is formed with a gradually increasing sound wave amplitude when the player character 410 is approaching the sound marker 412, and a sound pattern is formed with a gradually decreasing sound wave amplitude when the player character 410 is moving away from the sound marker 412. When the position of the player character 410 conforms to the position of the sound marker 412, the player character 410 picks up the sound marker 412.

When the main CPU 101 determines that the player character 101 has reached the critical reaching distance (S415; YES), the main CPU 101 attenuates the sound wave completely (S101) and quits the processing.

According to the embodiment above, by arranging the sound marker 412 at a prescribed position or by throwing the sound marker 412 and arranging it at a prescribed position, the player may determine the situation of the player character 410 on the basis of the sound pattern generated from the sound marker 412.

FIG. 5 is a flowchart illustrating the first sound pattern processing. This flowchart shows, for example, the processing of distinguishing the sound marker 412 from another object when a sound wave is generated from the sound marker 412 or when there is an object generating a sound wave similar to that generated from the sound marker 412.

First of all, when a sound wave is heard from the marker 412 or other sound sources while the player character moves through the building 250 in the space, the player needs to determine whether the sound comes from the sound marker placed by the player or from a different sound source.

Therefore, the player arranges the sound marker 412 near the source of the signal located at certain coordinates. For example, the player may throw the sound marker 412 near the source of the signal.

The main CPU 101 determines on a constant basis whether or not the sound marker 412 has been arranged (S501-S501; NO). If the marker 412 is arranged near the coordinates (S501; YES), the main CPU 101 reads the data of the signal source (S102). If the main CPU determines according to such data that the source of the signal is the sound marker 412 theretofore arranged (S503; YES), the main CPU gives the sound block 12 a command not to generate a sound wave with a roaring tone (S504). Consequently, the speakers 4, 4 generate a sound wave without any roaring tone, and the player will know that the sound has been generated by the sound marker 412 which was arranged by the player.

On the other hand, if the main CPU 101 determines on the basis of such data that the sound wave does not come from the sound marker (S503; NO), the main CPU 101 commands the sound block 12 to generate a sound wave with a roaring tone (S505). Consequently, the speakers 4, 4 generate a sound wave with a roaring tone, and the player will know that the sound comes from another object (for example, an enemy object).

Thus, the player may distinguish whether the sound comes from the sound marker 412 arranged in respect to the sound source object or any other object.

Consequently, according to the embodiment above, the player can enjoy the game on the basis of the sound pattern being provided.

As explained above, according to the present invention, instead of depending on one's visual sense, the player may freely operate the sound source and enjoy the game based on the reflected sounds of the sound waves generated from the sound source and the changes in the tones of the sound waves.

Furthermore, according to the present invention, by operating the operation device, sounds particular to respective objects are audible at prescribed positions and in prescribed directions, thereby allowing determination of physical positions and content of an object located in the virtual space and providing a new game environment not dependent on the game picture.

What is claimed is:

1. A method of generating virtual three-dimensional sound patterns whereby sound patterns are formed within a virtual three-dimensional space, comprising the steps of:

controlling movement of a player character and a sound marker for the player character in the virtual three-dimensional space on the basis of operational commands, and controlling a direction of a wave of sound of a first type generated by a sound source object;

variably controlling sound information of a second type generated by the sound marker in response to the wave of sound of the first type generated by the sound source object in accordance with the direction of the wave of sound of the first type, relative to positions of the sound source object and the sound marker within the virtual three-dimensional space; and allowing sounds to be heard by the player character at prescribed positions and in prescribed directions within the virtual three-dimensional space based on the direction of the wave of sound of the first type, and the relative positions of the player character and the sound marker.

2. The method of generating virtual three-dimensional sound patterns according to claim 1, further comprising:

changing the sound information of the sound marker in accordance with information on materials of a plurality of virtual objects upon identification of a collision of the sound marker with at least one of the virtual objects.

3. The method of generating virtual three-dimensional sound patterns according to claim 1, further comprising:

forming the sound information indicating motion of the player character within the virtual three-dimensional space.

4. The method of generating virtual three-dimensional sound patterns according to claim 1, further comprising:

reproducing three-dimensional sounds.

5. A computer-readable medium containing instructions for performing a method according to claim 1 when executed by a processing portion of a computer or a data device.

6. The method of generating virtual three-dimensional sound patterns according to claim 1, further comprising:

presenting the virtual three-dimensional space in a dark environment.

7. The method of generating virtual three-dimensional sound patterns according to claim 1, further comprising:

implementing attenuation processing for the sounds heard by the player character.

8. The method of generating virtual three-dimensional sound patterns according to claim 1, further comprising:

implementing attenuation processing according to whether or not the wave of sound travels a predetermined distance.

* * * * *